US006706239B2

(12) United States Patent
Haack et al.

(10) Patent No.: US 6,706,239 B2
(45) Date of Patent: Mar. 16, 2004

(54) METHOD OF CO-FORMING METAL FOAM ARTICLES AND THE ARTICLES FORMED BY THE METHOD THEREOF

(75) Inventors: David P. Haack, Hendersonville, NC (US); Chi-Li Lin, Weaverville, NC (US); Michael Speckert, Asheville, NC (US)

(73) Assignee: Porvair PLC (GB)

( * ) Notice: Subject to any disclaimer, the term of this patent is extended or adjusted under 35 U.S.C. 154(b) by 411 days.

(21) Appl. No.: 09/776,643

(22) Filed: Feb. 5, 2001

(65) Prior Publication Data

US 2002/0104405 A1 Aug. 8, 2002

(51) Int. Cl.[7] ..... B22F 3/10; B22F 3/20
(52) U.S. Cl. ..... 419/2; 419/8; 419/9; 428/613
(58) Field of Search ..... 419/2, 8, 9; 428/613

(56) References Cited

U.S. PATENT DOCUMENTS

| | | | | |
|---|---|---|---|---|
| 3,496,058 | A | 2/1970 | Schroter et al. | 161/119 |
| 3,689,320 | A | 9/1972 | Ashcroft et al. | 136/75 |
| 3,833,386 | A | 9/1974 | Wood et al. | 106/41 |
| 3,874,983 | A | 4/1975 | Hay, II et al. | 161/102 |
| 3,897,221 | A | 7/1975 | Salyer et al. | 29/191.2 |
| 3,933,521 | A | 1/1976 | Vissers et al. | 136/6 |
| 3,968,561 | A | 7/1976 | Oakes et al. | 29/460 |
| 4,161,561 | A | 7/1979 | Krug | 428/213 |
| 4,169,304 | A | 10/1979 | Binder | 29/155 |
| 4,256,799 | A | 3/1981 | Ohashi et al. | 428/215 |
| 4,292,361 | A | 9/1981 | Ohashi et al. | 428/215 |
| 4,292,369 | A | 9/1981 | Ohashi et al. | 428/313 |
| 4,366,203 | A | 12/1982 | Briggs | 428/304.4 |
| 4,411,679 | A | 10/1983 | Pelton | 65/22 |
| 4,468,431 | A | 8/1984 | Okey | 428/317.7 |
| 4,569,821 | A | 2/1986 | Duperray et al. | 419/2 |
| 4,687,702 | A | 8/1987 | Monsees | 428/308.4 |
| 4,698,278 | A | 10/1987 | Prang | 428/314.4 |
| 4,743,485 | A | 5/1988 | Ting | 428/109 |
| 4,751,137 | A | 6/1988 | Hälg et al. | 428/317.1 |
| 4,900,368 | A | 2/1990 | Brotz | 136/253 |
| 5,009,952 | A | 4/1991 | Klepsch et al. | 428/319.1 |
| 5,030,488 | A | 7/1991 | Sobolev | 428/35.9 |
| 5,112,697 | A | 5/1992 | Jin et al. | 428/613 |
| 5,185,297 | A | 2/1993 | Park et al. | 501/80 |
| 5,219,629 | A | 6/1993 | Sobolev | 428/35.9 |
| 5,300,165 | A * | 4/1994 | Sugikawa | 156/150 |
| 5,324,333 | A | 6/1994 | Doniat et al. | 29/623.5 |
| 5,334,236 | A | 8/1994 | Sang et al. | 75/415 |
| 5,372,380 | A | 12/1994 | Duffy et al. | 280/740 |

(List continued on next page.)

FOREIGN PATENT DOCUMENTS

| | | | |
|---|---|---|---|
| EP | 0 185 830 | 7/1986 | |
| EP | 0552133 A1 * | 7/1993 | C01B/13/32 |
| EP | 1 008 406 A2 | 6/2000 | |
| JP | 60050395 A | 3/1985 | |
| WO | WO 99/52661 | 10/1999 | |

*Primary Examiner*—Daniel J. Jenkins
(74) *Attorney, Agent, or Firm*—Kennedy Covington Lobdell & Hickman, LLP

(57) ABSTRACT

A method of co-forming a metal article comprising forming a powdered metal component from a first powdered metal composition, providing a polymeric foam, coating the polymeric foam with a second powdered metal composition to form a coated polymeric foam, placing the coated polymeric foam in contact with the powdered metal component to form a composite, and heat-treating the composite to volatilize the polymeric foam and to solidify the powdered metal component. The powdered metal composition of the powdered metal component can be the same or different than the powdered metal composition used to coat the polymeric foam. The resulting co-formed metal article can be in a variety of configurations including, but not limited to, metal foam on the inside or outside surfaces of a metal tube and metal foam on one or more faces of a metal plate.

36 Claims, 7 Drawing Sheets

U.S. PATENT DOCUMENTS 5,468,168 A 11/1995 Balaschak et al. ..... 445/26
5,522,976 A 6/1996 Campet et al. ..... 204/298.13
5,532,043 A 7/1996 Terashi et al. ..... 428/152
5,627,219 A 5/1997 Ogawa ..... 521/99
5,738,907 A * 4/1998 Vaccaro et al. ..... 427/172
5,839,049 A * 11/1998 Ettel et al. ..... 419/2
5,849,407 A 12/1998 Seibert ..... 428/316.6
5,851,459 A 12/1998 Chen ..... 264/46.7
5,881,353 A 3/1999 Kamigata et al. ..... 419/2
5,895,726 A 4/1999 Imam et al. ..... 428/615
5,900,320 A 5/1999 Ogawa et al. ..... 428/457
5,926,685 A 7/1999 Krebs et al. ..... 419/2
5,930,580 A 7/1999 Everett ..... 419/2
5,937,263 A 8/1999 Eisenmann et al. ..... 419/2
5,943,543 A 8/1999 Uchida et al. ..... 419/2
5,972,285 A 10/1999 Knott ..... 419/2
5,972,521 A 10/1999 Huskamp et al. ..... 428/547
5,976,454 A 11/1999 Sterzel et al. ..... 419/2
5,993,502 A 11/1999 Motoki et al. ..... 55/487
6,040,266 A 3/2000 Fay, III et al. ..... 502/439
6,051,117 A * 4/2000 Novak et al. ..... 204/252
6,080,219 A * 6/2000 Jha et al. ..... 55/486
6,080,357 A 6/2000 Sugikawa ..... 419/2
6,080,375 A 6/2000 Mussmann et al. ..... 423/213.5
6,083,002 A 7/2000 Martin et al. ..... 433/90
6,085,965 A 7/2000 Schwartz et al. ..... 228/190
6,087,024 A 7/2000 Whinnery et al. ..... 428/613
6,090,232 A 7/2000 Seeliger et al. ..... 156/79
6,094,798 A 8/2000 Seeliger et al. ..... 29/469
6,096,416 A 8/2000 Altenberg ..... 428/317.7
6,140,266 A 10/2000 Corrigan et al. ..... 502/439
6,238,819 B1 * 5/2001 Cahill et al. ..... 429/162
6,383,687 B1 * 5/2002 Gibbons et al. ..... 429/233
6,391,250 B1 5/2002 Wolfsgruber et al. ..... 419/2

* cited by examiner

METHOD OF CO-FORMING METAL FOAM ARTICLES AND THE ARTICLES FORMED BY THE METHOD THEREOF

FIELD OF THE INVENTION

The present invention relates to a method of co-forming an article from a metal foam and a powdered metal component. The present invention also relates to the co-formed metal foam article formed by the method thereof. The article of the present invention is suitable for a number of purposes including enhancing heat and mass transfer and promoting chemical reactions.

BACKGROUND OF THE INVENTION

There are a number of known methods for forming a metal article from a metal foam and a metal component. However, in these known methods, the metal component has already been formed and solidified by a conventional metal-forming method such as extrusion, rolling, forging and casting, prior to being contacted with or joined with the metal foam. For example, in some known methods a cylinder of polymeric foam that has been impregnated with a slurry coating of powdered metal is inserted into a solid metal component such as a tube. This coated polymeric foam unit is referred to as a "green" assembly. The green assembly is then placed into a sintering furnace and heat-treated to volatize the polymeric foam and to sinter the metal foam. The metal foam is then contacted with or joined to the metal component(s) by a conventional bonding method such as brazing, welding, soldering, and crimping. Examples of these known methods wherein the metal component has already been formed and solidified by a conventional metal-forming method prior to being contacted with or joined with the metal foam are set forth below.

U.S. Pat. No. 5,943,543 relates to a heat transmitting member which is capable of improving heat transfer efficiency wherein the member is comprised of either a metal pipe or a metal plate.

Japanese patent application JP 60050395 discloses a method of forming a radiator wherein pipes are wrapped with a metal foam.

U.S. Pat. No. 5,943,543 discloses preparing a cellular synthetic resin structure such as a polyurethane foam which may be coated with an adhesive. A metal powder is then deposited onto the cellular structure. The metal pipe or metal plate which has already been manufactured by a conventional metal-forming method is placed adjacent to one or more surfaces of the polyurethane foam such that the foam and the metal pipe or metal plate are placed in contact with the polyurethane foam. Thereafter, the polyurethane foam is burnt away by heating the polyurethane foam and the metal pipe or metal plate to an appropriate temperature such that the metal material is fixed on and made unitary with one or more surfaces of the metal pipe or metal plate.

U.S. Pat. No. 6,085,965 discloses a method of forming low density core metal parts by pressure bonding face sheets already manufactured by conventional metal-forming methods to a porous foam metal core and simultaneously densifying the core. The method includes the steps of providing a porous, foam metal core and simultaneously pressure bonding first and second solid metal face sheets directly to opposite sides of the core and densifying the core by applying heat and uniaxial forge pressure to the first and second face sheets and to the core for a predetermined period of time.

However, there is a very significant problem that results from these known methods. Shrinkage occurs in the foam whereas little or no shrinkage occurs in the metal component such as the metal plate or metal tube, thereby creating a gap or space between the metal foam and the metal plate or metal tube. This gap creates numerous problems including, for example, a reduction in heat transfer efficiency. Thus, until now, there has been a need for a method of forming an article from a metal foam that overcomes the problems resulting from shrinkage. The method of the present invention surprisingly solves this problem.

SUMMARY OF THE INVENTION

The present invention relates to a method of making an article that is comprised of a metal foam joined to a metal component. In particular, the present invention relates to a method of co-forming a powdered metal component and a coated polymeric foam to form a metal article. In the method, a powdered metal component is formed from a powdered metal composition. In the method, a polymeric foam is also coated with a powdered metal composition which may be the same or different than the composition of the powdered metal component. The coated polymeric foam is placed in contact with the powdered metal component to form a composite, and the composite is heat-treated. The heat-treatment volatilizes the polymeric foam and solidifies the powdered metal component and the coating such that the co-formed metal article is formed. An advantage of the method of the present invention is that it eliminates any gaps or spaces associated with shrinkage of the metal foam by allowing the powdered metal component to shrink along with the metal foam. As a result, a good, continuous bond is created between the metal foam and the powdered metal component.

DESCRIPTION OF THE PREFERRED EMBODIMENTS

Figure 1:
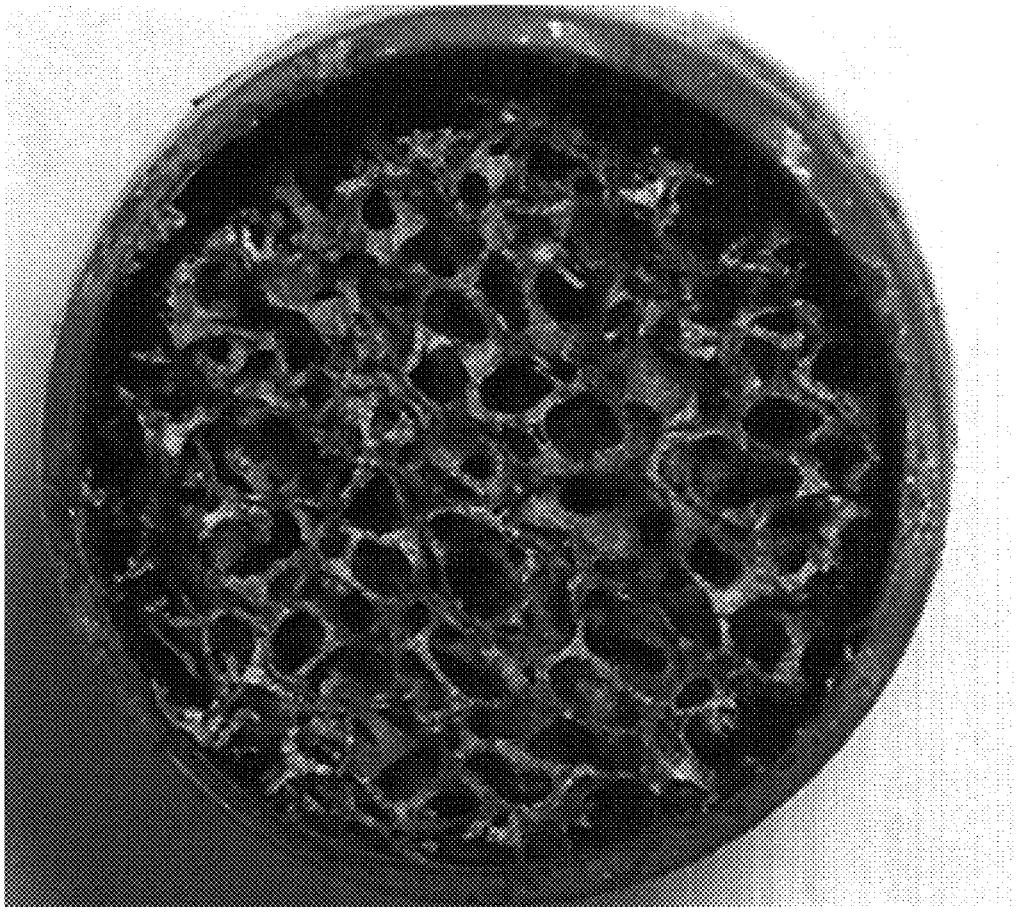
FIG. 1 is a photograph of a cross-section of a metal tube with metal foam inside the metal tube wherein the metal tube is formed by a conventional metal-forming method.

The present invention relates to a method of co-forming a metal article comprising forming a powdered metal component from a first powdered metal composition, providing a polymeric foam, coating the polymeric foam with a second powdered metal composition to form a coated polymeric foam, placing the coated polymeric foam in contact with the powdered metal component to form a composite, and heat-treating the composite to volatilize the polymeric foam of the coated polymeric foam and to solidify the powdered metal component and the coating. The method does not depend upon the order in which the coated polymeric foam or the powdered metal component is prepared.

The term "co-forming," as used in the context of the present invention, refers to a method of producing a metal article by the heat-treatment of a powdered metal component in contact with a coated polymeric foam, wherein the polymeric foam is coated with a powdered metal composition. The term "co-formed," as used herein, refers to an article that is formed by the co-forming method of the present invention.

The term "powdered metal component," as used in the context of the present invention, refers to a component that is prepared from a "powdered metal composition" and that is formed into various configurations by known methods. These known methods include, but are not limited to, conventional methods such as dry-pressing, extrusion, slip casting, injection molding, freeform fabrication, and die pressing. Configurations of the powdered metal component include, but are not limited to, plates and tubes. The powdered metal component can also be formed into a sleeve-like configuration as set forth in Example 1 of the present invention.

The term "powdered metal composition," as used in the context of the present invention, refers to any composition that is comprised of a powdered metal. The powdered metal may be any metal that is in powder form. The powdered metal may be in any shape or particle size.

Metals suitable for use in the powdered metal composition of the present invention include, but are not limited to, iron, steel, steel alloys including stainless steel, aluminum, aluminum alloys, FeCrAlY, copper, brass, bronze, nickel, nickel alloys, cobalt, platinum, palladium, silver, lead, tin, and zirconium. Powdered metals that can be used in the compositions of the present invention include, but are not limited to, the powdered metals commercially available from Ultra Fine Powder Corporation of Woonsocket, R.I., Powder Alloy Corporation of Cincinnati, Ohio and Stellite Powder Corporation of Goshen, Ind.

The powdered metal composition may comprise additives and components other than powdered metals such as binders, liquids, and shrinkage aids. Examples of suitable binders include, but are not limited to, organic adhesives, starches, polyvinyl alcohol, acrylic binders, xantham gum, methylcellulose, and phenolic binders. Examples of suitable liquids include, but are not limited to, water and solvents. A shrinkage aid refers to any material that can be removed upon heat-treatment and that lowers the green density of the powdered metal component providing more room for shrinkage. Polymers may be shrinkage aids, for example.

The selection of the powdered metal composition itself depends not only upon the metal or metal alloy selected for both the powdered metal component and the metal foam but also upon the final configuration of the co-formed article. For example, different methods of green component manufacture require different material composition characteristics, including binders and powder particle sizes and shapes uniquely suited to each fabrication method. However, a typical powdered metal composition comprises approximately 0.1 weight % to 15 weight % of a binder, 0 to 40 weight % of a liquid, 0 to 5 weight % of a shrinkage aid, and the balance of the composition is a metal powder, such that the percent by weight is 100% based upon the total weight of the composition. It is important to note, however, that the powdered metal composition that is used to coat the polymeric foam may be the same as or different than the powdered metal composition used to form the powdered metal component.

The term "polymeric foam," as used in the context of the present invention, refers to any foam that is comprised of a polymer. Polymeric foams that are suitable for use in the present invention include, but are not limited to, foams comprising polyurethane, polyester, polyether, cellulose and any other reticulated (open-cell) organic foam. Preferred polymeric foams are polyurethane foams. Polymeric foams are commercially available from manufacturers such as Crest Corporation.

The term "coating," as used in the context of the present invention, refers to any method of applying a powdered metal composition to a polymeric foam or incorporating a powdered metal composition into a polymeric foam. Any coating method that is known in the art may be used. However, there are at least two preferred coating methods. These preferred methods are impregnation and dusting. In the impregnation method, a slurry formed of a powdered metal composition is mixed in a high speed mixer. The empty cavities of the polymeric foam are filled (i.e. impregnated) with the slurry. The excess of the slurry is then removed or extracted out of the polymeric foam by any means such as squeezing with rollers or via centrifuge. In the dusting method, the polymeric foam is treated with an adhesive or impregnated with a slurry containing an adhesive and then dusted with a powdered metal composition. Any excess is removed or extracted out of the polymeric foam by any means such as squeezing with rollers or via centrifuge.

The term "in contact," as used in the context of the present invention, refers to at least a portion of the coated polymeric foam touching or being adjacent to the powdered metal component. The geometry of the bond and the configuration of the resulting co-formed article define the manner in which the coated polymeric foam is placed in contact with, and ultimately bonded to, the powdered metal component. For example, in the case where the powdered metal component is in the shape of a tube, the coated polymeric foam may be in contact with the inside or outside surfaces of the tube. In the case where the powdered metal component is in the shape of a plate, the coated polymeric foam may be in contact with one or more faces of the plate. Any number of configurations is possible in contacting the coated polymeric foam with the powdered metal component in accordance with the method of the present invention. Examples of configurations possible with the co-forming method of the present invention include, but are not limited to,: 1) metal foam co-formed with a powdered metal tube wherein the metal foam is on the outer diameter of the tube, 2) metal foam co-formed with a powdered metal tube wherein the metal foam is on the inner diameter of the tube, 3) metal foam co-formed with a powdered metal in non-planar, but non-cylindrical shapes, 4) sandwiched or repeating structures (i.e. multiple sheets or layers of either material), and 5) three-dimensional shapes, such as box-like structures with multiple sides.

The term "heat-treating," as used in the context of the present invention, refers to any method of raising an object to a temperature near its melting temperature in a controlled atmosphere for a specified period of time. By "controlled atmosphere," it is meant that the environment is monitored and variables such as the type and quantity of chemicals present, the pressure, and the temperature, may be controlled to maintain a desired environment. This controlled atmosphere may be, for example, in a vacuum furnace, a retort furnace, or a control atmosphere furnace. Optionally, prior to heat-treating the composite can be dried to remove any excess liquid by any conventional means such as in a convection drier. The drying conditions, such as drying temperature and length of drying time, are not critical and are readily determined by one of ordinary skill in the art.

The manner of heat-treatment employed depends upon many factors including the configuration of the resulting co-formed article. The most important objects to achieve in heat-treating are to solidify the powdered metal component into a solid part and to volatilize the polymeric foam and any organics or binders in the powdered metal composition. Preferably, solidification occurs by sintering. The specific heat-treating conditions depend upon the final configuration of the co-formed article and the metal or metal alloy being fabricated in the co-forming method. Optimization in these cases is needed to discover the best heat-treating conditions for a given powdered metal component and depends upon factors such as the shape of the powdered metal component and whether the resulting powdered metal component is in solid or porous form. The temperature that one would need to solidify a given powdered metal composition and coating and to volatilize the polymeric foam in the heat-treating step is typically the temperature slightly below the melting point of the metal. However, the precise temperature and time that one would need to solidify a given powdered metal composition and coating and to volatilize the polymeric foam in the heat-treating step would be apparent to one of ordinary skill in the art. For example, if a powdered metal component is large or requires external support due to a non-planar shape, the firing temperatures may have to be adjusted.

Numerous applications exist for the co-formed articles produced by the method of the present invention, including use as advanced heat exchangers where the metallurgical bond serves to enhance conduction transfer through a solid tube or other material to the struts of the metal foam. Additional applications include bonding for mechanical strength and convenience in packaging. The present invention allows for further processing and packaging of the metal foam material, including the use of welding and secondary brazing operations to combine the composite with other materials and devices. Additional applications include chemical use where the metal foam is utilized as a catalyst or catalyst support to promote or enable chemical reactions. Additional applications include use in electrical applications, where the bonding serves to provide good electrical contact between conducting elements or other articles. Additional applications include the enhancement of thermal transfer process such as in steam generation and chemical processing and in the formation of a bipolar plate or current collector for a fuel cell. Numerous other applications exist that are not explicitly mentioned but are within the scope of the present invention.

The method of the present invention provides for superior performance in the above applications and is an improvement over present technology. The combination of a metal foam and a powdered metal component with metallurgical bonding characteristics can significantly increase thermal transfer rates in heat exchange applications, allowing for the construction of more compact, lighter weight devices. Similarly because of the metal foams capability to enhance catalytic and chemical reactions, the combination of the metal foam structure with a metal holder together as a package offers significantly improved convenience and reliability in use. Further, this packaging allows for attachment mechanisms not previously available, including welding and brazing the composite structures in place. The use of the co-formed article can be applied directly to processes such as steam generation and heat exchange, where high thermal transfer rates are desirable.

EXAMPLES

Example 1

A co-formed metal article in the form of a stainless steel foam plug sintered on its exterior to a stainless steel powder metal sleeve was prepared in accordance with the method of the present invention.

To prepare the powdered metal composition for the powdered metal component, stainless steel 316L powders, (−325 mesh from Ultrafine Powders, Inc.) were mixed with a binder (5% concentration Methocel from Dow Chemical in water), and a shrinkage aid (20% hollow polymer spheres from P.Q. Corp., 50–80 $\mu$m, part number 6545). The mixture quantities correspond to 92.65 weight % stainless steel powder, 7.3 weight % binder and 0.05 weight % shrinkage aid wherein the weight percent is based on the total weight of the composition. The ingredients were mixed using a bench-top kneading mixer until all ingredients were thoroughly blended into a dough-like consistency.

Figure 5:
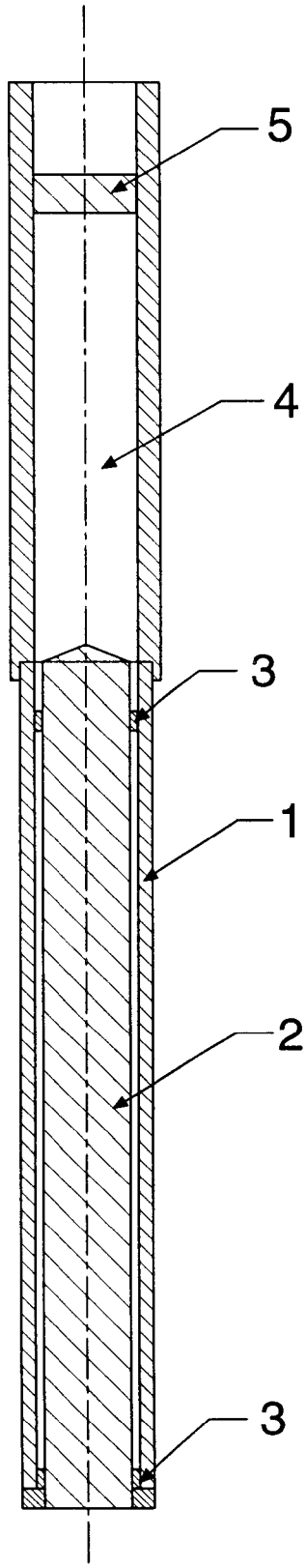
FIG. 5 is a diagram of a steel mold used to illustrate an embodiment of the present invention.

The dough was pressed into a steel mold under pressure from a manually operated arbor press. The steel mold depicted in FIG. 5, consisted of an outer die 1, a center pin 2, centering rings 3, a material reservoir 4 and a press plug 5. The centering rings 3 held the center pin 2 centered within the outer die 1 before dough was introduced. The dough was loaded into the material reservoir 4, and the press plug 5 was put into place. The dough was pressed into the annulus between the outer die 1 and the center pin 2 until full, with an arbor press of maximum capacity of two tons. After pressing, the assembly was allowed to sit in room-temperature air for about 1 hour before removing the center pin 2.

The polymeric foam insert was manufactured according to the following procedure. An open-cell, reticulated polyurethane foam of 20 pores per 25.4 mm (20 pores per inch) designation (Stephenson & Lawyer, Inc.) was used in combination with a stainless steel slurry composition. The slurry was made by combining −325 mesh stainless steel powders (Ultrafine Powders, Inc.), a 6% solution of polyvinyl alcohol (Air Products Airvol 165), glycerin and water in relative quantities of 88 weight %, 9.8 weight %, 0.5 weight %, and 1.7 weight % respectively based on the total weight of the composition. The ingredients were mixed thoroughly to form the desired slurry. The polymeric foam was cut to its cylindrical dimension 31.75 mm diameter, by 279.4 mm length (1.25 in. diameter, by 11 in. length) using a thin-blade core drill on a drill press. The polymeric foam was then coated by impregnating it with the slurry by dipping the polymeric foam into the slurry and pressing out the excess under a mechanized roller so that the weight of the slurry remaining within the polymeric foam material corresponded to 5% of the theoretical density of stainless steel for the cylindrical geometry. Following this coating procedure, the foam cylinder was inserted into the center of the sleeve, where center pin 2 had been previously removed.

The outer die 1 with dough sleeve and inner polymeric foam plug contained within was then placed into a convection drier at 200° Fahrenheit (F.) (366 Kelvin) for 12 hours (43200 seconds) to fully dry the dough and coated polymeric foam. The composite was then removed from the outer die 1 by lightly forcing the press plug 5 into the interior with an arbor press until release occurred.

The unfired composite was then placed into a vacuum furnace and heat-treated according to the following cycle: 1) heated from room temperature to 2250° F. (1505 Kelvin) at 10° F./minute (4.3 Kelvin/second) held at 750 microns of mercury of argon partial pressure, 2) held at 2250° F. (1505 Kelvin) for 30 minutes (1800 seconds), 3) heated at 5° F./min to 2300° F., held at 750 microns of mercury of argon partial pressure, 4) held at 2300° F. for 30 minutes, 5) vacuum cooled to 1600° F. under 750 microns of mercury of argon partial pressure, and 6) force-cooled to room temperature with an internal fan at −5 in. Hg gauge pressure argon.

The co-formed article was sectioned to view the interior structure and the quality of the interior foam-to-sleeve bonds. Observations showed that the metal foam was well bonded to the sleeve interior.

Example 2

A cylindrical co-formed article was prepared as set forth in Example 1 and was machined on its outside diameter to produce a metal foam-containing composite tube with tube diameter tolerances of better than 0.0254 mm (0.001 in) and with a surface finish of 16 microinches. The co-formed article was machined on a 609.6 mm (24 inch) lathe using standard, sharp lathe machinery tooling, along with glycol lubricant/coolant fluid. The lathe rate of rotation and the tool rate of translation were set to 400 rpm and 50.8 mm/min (2 in/min), respectively. Final polishing was achieved with emery cloth and steel wool to achieve the 16 microinches finish.

Example 3

Cylindrical co-formed articles with dimensions of 35 mm outside diameter, 32 mm inside diameter, and 25 mm length were prepared using the method of the present invention. The co-formed articles were prepared with a stainless steel 316L exterior sleeve and a FeCrAlY foam interior plug of 3–5 pores per 25.4 mm (3–5 pores per inch). The method employed was identical to that of Example 1 except that: 1) a unique die set was fabricated to achieve the desired finished article dimensions, 2) the outer sleeve was formed such that its final density was less than 80% of fully-dense stainless steel 316L, and 3) the polymeric foam material was made from FeCrAlY. The powdered metal composition of the dough in this example was 92.9 weight % stainless steel powders (−325 mesh from Ultrafine Powders, Inc.), 6.55 weight % Methocel, and 0.55 weight % polymer spheres from P.Q. Corp., 50–80 $\mu$m, part number 6545. The dough mixing and pressing procedure was identical to that described in Example 1. The FeCrAlY slurry generation, and the foam coating procedures were identical to those described in Example 1 for the SS-316L slurry. The composition of the FeCrAlY slurry for the polymeric foam was 87 weight % FeCrAlY powders (−325 mesh from Ultrafine Powders, Inc.) and 13 weight % of a 6% polyvinyl alcohol solution. As in Example 1, following pin removal, the coated foam was inserted into the unfired stainless steel sleeve and the composite was convection dried for one hour at 150° F.

The composite was then heat-treated under the following firing cycle: 1) heated from room temperature to 2392° F. at 10° F./min under 750 microns of mercury of argon partial pressure, 2) held at 2392° F. for 30 minutes, 3) heated at 1° F./min to 2402° F. under 75 microns of mercury of argon partial pressure, 4) held 30 minutes at 750 microns of mercury of argon partial pressure, 5) vacuum cooled to 1600° F. at 750 microns of mercury of argon partial pressure, 6) force cooled with an internal fan at −5 in. Hg gauge pressure argon to room temperature. The co-formed article was finished following this heat-treatment.

Example 4

A co-formed metal article was prepared in the form of a stainless steel foam slab sandwiched by two co-formed stainless steel plates. The co-formed article was prepared as follows. The dough was prepared as described in Example 1 and was pressed onto a flat plate under a manually-operated arbor press to 1.778 mm to (0.07 inch) thickness. After pressing, the sheet was dried in a convection dryer. A second sheet was formed using the same method. After drying, the two sheets were cut to the desired dimension of 203.2 mm (8 inch) square using a sharp knife. A foam blank of 203.2 mm (8 inch) square by 22.86 mm (0.9 inch) thick was then coated by impregnating it with a SS-316L slurry to 5% density, following the procedure in Example 1. A thin layer of slurry was then applied to the interior faces of each dried stainless steel dough sheet. While both the coated foam and the slurry layer on the dough sheets were still wet, the polymeric foam was inserted between the two dough sheets. The resulting composite was then placed into a convection dryer to dry fully (200° F. for approximately 2 hours).

The unfired composite was then placed into a vacuum furnace and heat-treated following the heating cycle described in Example 1 to obtain the final co-formed article. The co-formed article was examined to view the quality of the interior foam-to-slab bonds. Observations showed that the metal foam was well bonded to the outer co-formed metal sheets.

Example 5

Figure 3A:
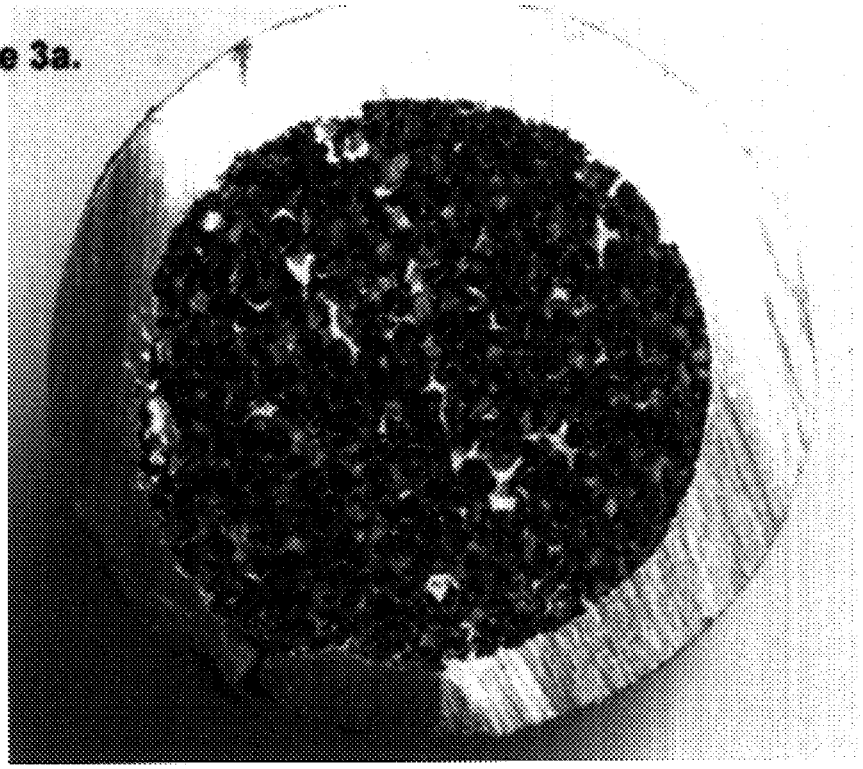
FIG. 3A is a photograph of a co-formed article (a metal foam inside a metal tube) produced in accordance with the method of the present invention.
Figure 3B:
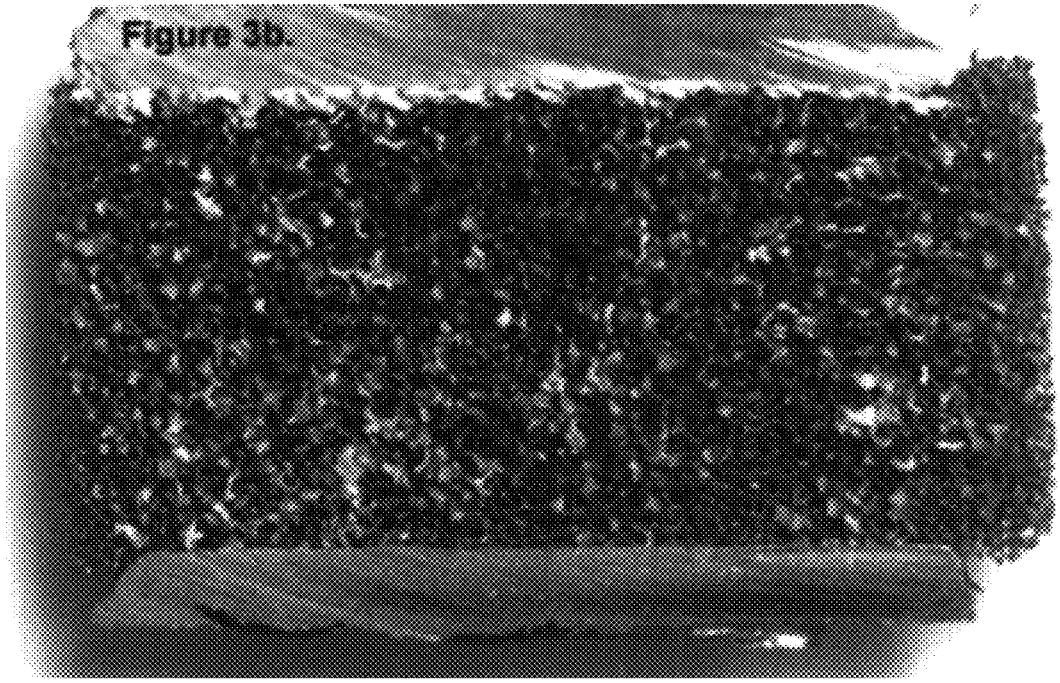
FIG. 3B is a photograph of the cross-sectional view of the article of FIG. 3A illustrating that the metal foam of the co-formed article is in contact with the wall of the metal tube.
Figure 3C:
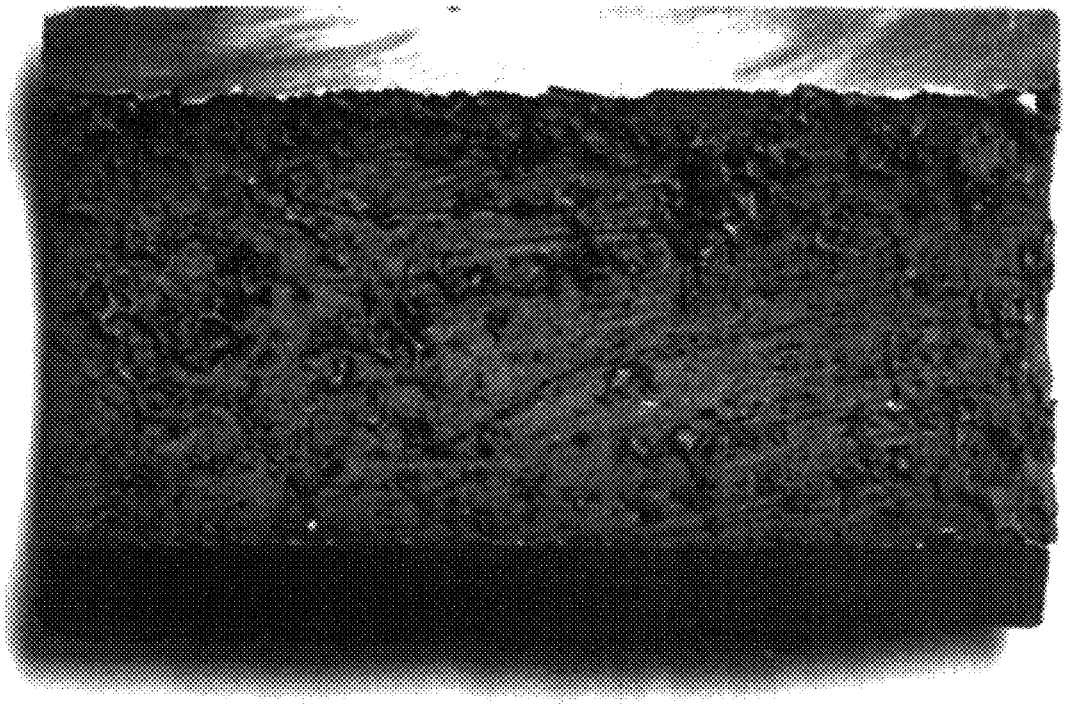
FIG. 3C is a photograph of the co-formed article of FIG. 3A wherein the metal foam in one sectioned half was removed to show the bonding between the metal foam and wall of the metal tube in the co-formed article.

FIGS. 3A, 3B and 3C are sectional views of a co-formed article prepared in accordance with the method of the present invention wherein the metal foam and the powdered metal component were of stainless steel. These figures demonstrate the effectiveness of the method of the present invention in producing gap-free fits between the metal foam and the tube. FIG. 3C in which the metal foam was forcibly removed demonstrates bonding effectiveness by revealing foam attachment points on the tube interior. For this example, the metal foam was removed by tearing and grinding.

Comparative Example 1

This comparative example illustrates the effect of shrinkage when an article is formed out of a metal foam and a metal component formed by a conventional metal-forming method. This comparative also demonstrates the surprising results associated with the method of the present invention and the articles formed thereby.

Figure 2:
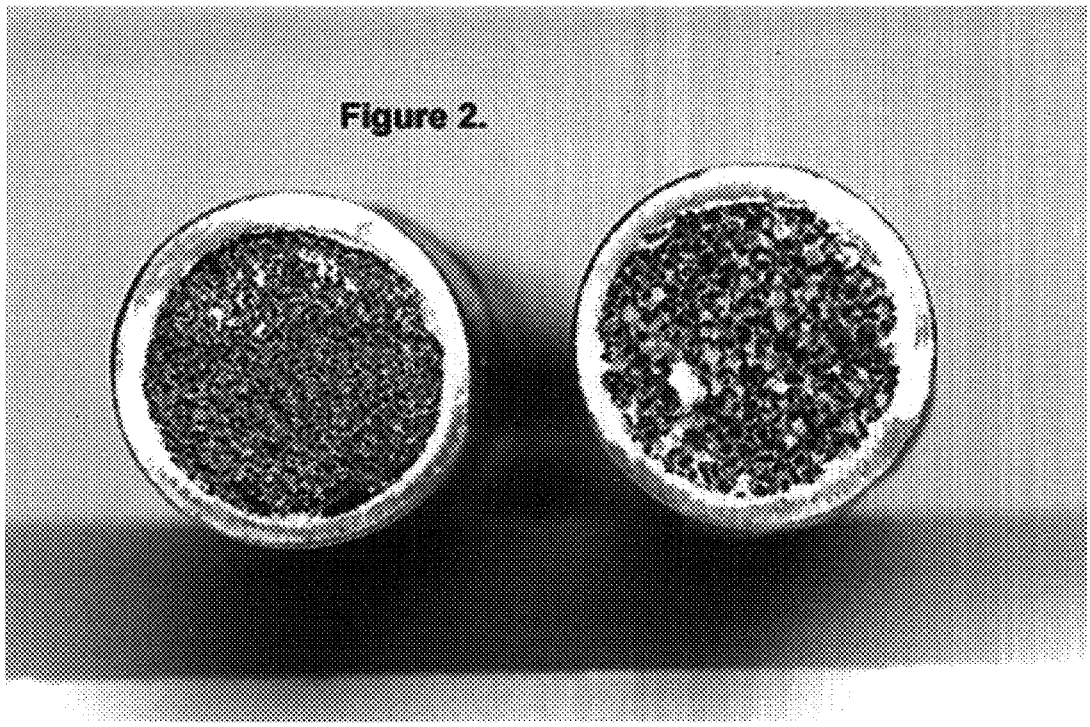
FIG. 2 is a photograph of a co-formed article produced in accordance with the method of the present invention.

FIG. 1 shows an article that is typical of those comprising a metal component formed by a conventional metal-forming method. Shrinkage can be seen as there is a gap between the metal tube and the metal foam. The problem lies in the fact that during the sintering process the metal foam undergoes several percent linear shrinkage. The tube which is formed from a solid metal formed by a conventional metal-forming method does not shrink along with the metal foam. Thus, a gap is formed between the metal foam and the solid metal tube. In contrast, FIG. 2 shows a co-formed article made by the method of the present invention. In the present method, rather than beginning with a solid metal tube formed by a conventional metal-forming method, the present method employs a tube formed of a powdered metal composition. The coated polymeric foam is inserted into the powdered metal tube and the composite is heat-treated together. Thus, in the present invention, as shown in FIG. 2, the tube shrinks along with the foam and a good, continuous bond is created between the metal foam and the wall of the tube.

Comparative Example 2

Figure 4:
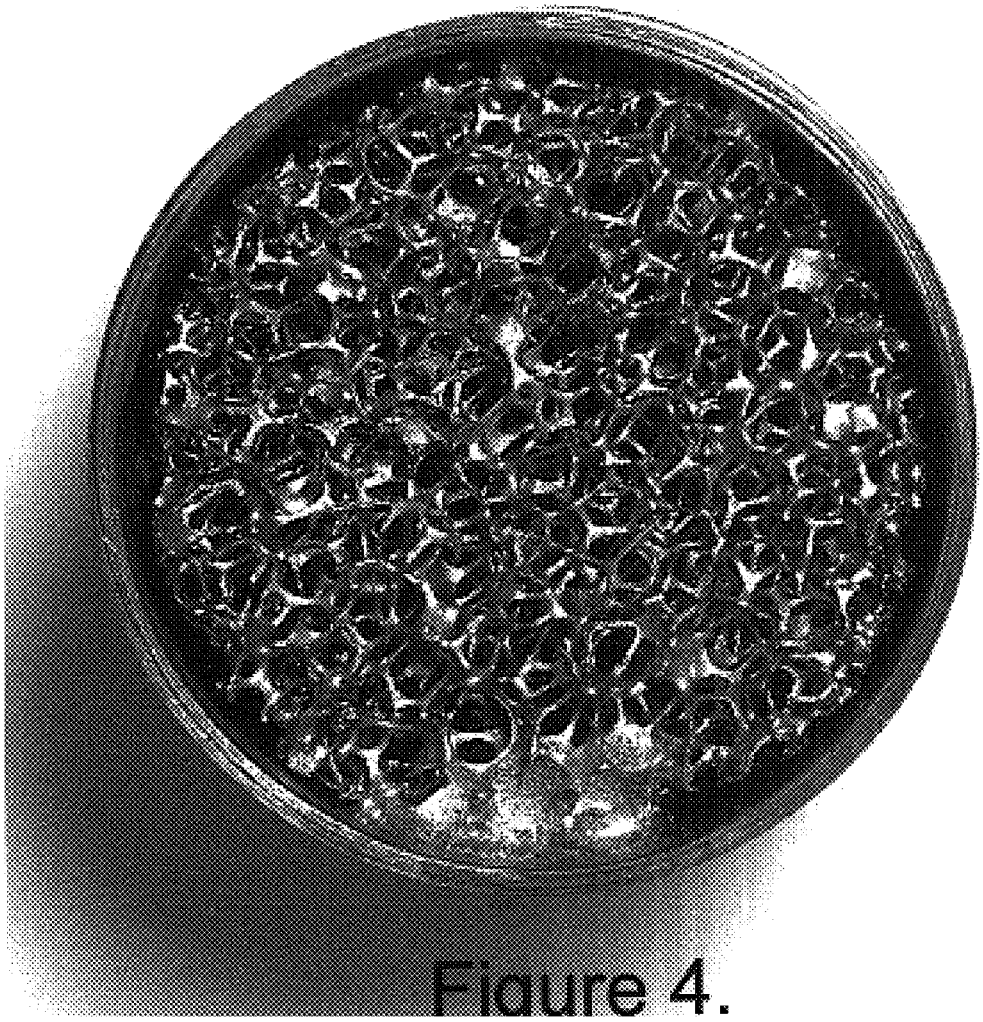
FIG. 4 is a photograph of the top view of a metal foam brazed to the interior of a metal tube formed by a conventional metal-forming method illustrating that braze (i.e. melted foil) was collected in localized regions of the metal tube and that in other regions of the metal tube there was a gap between the metal foam and the wall of the metal tube.

This comparative example illustrates a metal article formed by brazing which is a conventional joining process, and the problems associated therewith. In this example, brazed foil was wrapped around a plug of stainless steel foam, and the composite was pressed into a stainless steel tube. A brazing cycle was run to set the bond. FIG. 4 illustrates an example of the trial. The result was poor uniformity of the bond. There were gaps as much of the foam material was not in contact with the tube wall.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A method of co-forming a metal article comprising:

a) forming a powdered metal component from a first powdered metal composition, b) providing a polymeric foam, c) coating the polymeric foam with a second powdered metal composition to form a coated polymeric foam, d) placing the coated polymeric foam in contact with the powdered metal component to form a composite, and e) heat-treating the composite to volatilize the polymeric foam and to solidify the powdered metal component and the coating and to bond the formed metal foam to the powdered metal component.

2. The method as claimed in claim 1, wherein the first powdered metal composition is the same as the second powdered metal composition.

3. The method as claimed in claim 1, wherein the polymeric foam is a reticulated organic foam.

4. The method as claimed in claim 3, wherein the reticulated organic foam is a polyurethane.

5. The method as claimed in claim 1, wherein the first powdered metal composition comprises a metal selected from the group consisting of iron, steel, steel alloys, aluminum, aluminum alloys, FeCrAly, copper, brass, bronze, nickel, nickel alloys, cobalt, platinum, palladium, silver, lead, tin, and zirconium.

6. The method as claimed in claim 1, wherein the second powdered metal composition comprises a metal selected from the group consisting of iron, steel, steel alloys, aluminum, aluminum alloys, FeCrAlY, copper, brass, bronze, nickel, nickel alloys, cobalt, platinum, palladium, silver, lead, tin, and zirconium.

7. The method as claimed in claim 1, wherein the composite is dried prior to heat-treating.

8. The method as claimed in claim 1, wherein coating is conducted by impregnating or by dusting the polymeric foam.

9. A method of co-forming a metal article comprising:

a) forming a powdered metal component from a first powdered metal composition, b) providing a polymeric foam, c) impregnating the polymeric foam with a slurry comprising a second powdered metal composition to form an impregnated polymeric foam, d) removing any excess of the slurry from the impregnated polymeric foam, e) placing the impregnated polymeric foam in contact with the powdered metal component to form a composite, and f) heat-treating the composite to volatilize the polymeric foam and to sinter the powdered metal component and the coating and to bond the formed metal foam to the powdered metal component.

10. The method as claimed in claim 9, wherein the first powdered metal composition is the same as the second powdered metal composition.

11. The method as claimed in claim 9, wherein the polymeric foam is a reticulated organic foam.

12. The method as claimed in claim 11, wherein the reticulated organic foam is a polyurethane.

13. The method as claimed in claim 9, wherein the first powdered metal composition comprises a metal selected from the group consisting of iron, steel, steel alloys, aluminum, aluminum alloys, FeCrAly, copper, brass, bronze, nickel, nickel alloys, cobalt, platinum, palladium, silver, lead, tin, and zirconium.

14. The method as claimed in claim 13, wherein the first powdered metal composition comprises a steel alloy.

15. The method as claimed in claim 9, wherein the second powdered metal composition comprises a metal selected from the group consisting of iron, steel, steel alloys, aluminum, aluminum alloys, FeCrAlY, copper, brass, bronze, nickel, nickel alloys, cobalt, platinum, palladium, silver, lead, tin, and zirconium.

16. The method as claimed in claim 15, wherein the second powdered metal composition comprises a steel alloy.

17. The method as claimed in claim 9, wherein the composite is dried prior to heat-treating.

18. A method of co-forming a metal article wherein the article is comprised of a metal foam and a metal tube, the method comprising:

a) forming a powdered metal tube having an inside surface and an outside surface from a first powdered metal composition, b) providing a polymeric foam, c) coating the polymeric foam with a second powdered metal composition to form a coated polymeric foam, d) placing the coated polymeric foam in contact with the inside surface or the outside surface of the tube to form a composite, and e) heat-treating the composite to volatilize the polymeric foam and to solidify the powdered metal tube and the coating and to bond the formed metal foam to the powdered metal component.

19. The method as claimed in claim 18, wherein the first powdered metal composition is the same as the second powdered metal composition.

20. The method as claimed in claim 18, wherein the polymeric foam is a reticulated organic foam.

21. The method as claimed in claim 20, wherein the reticulated organic foam is a polyurethane.

22. The method as claimed in claim 18, wherein the first powdered metal composition comprises a metal selected from the group consisting of iron, steel, steel alloys, aluminum, aluminum alloys, FeCrAlY, copper, brass, bronze, nickel, nickel alloys, cobalt, platinum, palladium, silver, lead, tin, and zirconium.

23. The method as claimed in claim 22, wherein the first powdered metal composition comprises a steel alloy.

24. The method as claimed in claim 18, wherein the second powdered metal composition comprises a metal selected from the group consisting of iron, steel, steel alloys, aluminum, aluminum alloys, FeCrAlY, copper, brass, bronze, nickel, nickel alloys, cobalt, platinum, palladium, silver, lead, tin, and zirconium.

25. The method as claimed in claim 24, wherein the second powdered metal composition comprises a steel alloy.

26. The method as claimed in claim 18, wherein the composite is dried prior to heat-treating.

27. A method of co-forming a metal article wherein the article is comprised of a metal foam on one or more faces of a metal sheet, the method comprising:

a) forming a powdered metal sheet having one or more faces from a first powdered metal composition, b) providing a polymeric foam, c) coating the polymeric foam with a second powdered metal composition to form a coated polymeric foam, d) placing the coated polymeric foam in contact with one or more of the faces of the powdered metal sheet to form a composite, and e) heat-treating the composite to volatilize the polymeric foam and to solidify the powdered metal sheet and the coating and to bond the formed metal foam to the powdered metal component.

28. The method as claimed in claim 27, wherein the first powdered metal composition is the same as the second powdered metal composition.

29. The method as claimed in claim 27, wherein the polymeric foam is a reticulated organic foam.

30. The method as claimed in claim 29, wherein the reticulated organic foam is a polyurethane.

31. The method as claimed in claim 27, wherein the first powdered metal composition comprises a metal selected from the group consisting of iron, steel, steel alloys, aluminum, aluminum alloys, FeCrAlY, copper, brass, bronze, nickel, nickel alloys, cobalt, platinum, palladium, silver, lead, tin, and zirconium.

32. The method as claimed in claim 31, wherein the first powdered metal composition comprises a steel alloy.

33. The method as claimed in claim 27, wherein the second powdered metal composition comprises a metal selected from the group consisting of iron, steel, steel alloys, aluminum, aluminum alloys, FeCrAlY, copper, brass, bronze, nickel, nickel alloys, cobalt, platinum, palladium, silver, lead, tin, and zirconium.

34. The method as claimed in claim 33, wherein the second powdered metal composition comprises a steel alloy.

35. The method as claimed in claim 27, wherein the composite is dried prior to heat-treating.

36. A co-formed metal article produced by the method of claim 1.

* * * * *